United States Patent [19]

Eldred

[11] Patent Number: 4,906,293

[45] Date of Patent: Mar. 6, 1990

[54] HYDROMETALLURGICAL PROCESS FOR EXTRACTING METALS FROM OCEAN-MINED FERROMANGANESE NODULES

[76] Inventor: Daniel S. Eldred, 7523 N. 35th Ave., Phoenix, Ariz. 85021

[21] Appl. No.: 771,763

[22] Filed: Sep. 3, 1985

[51] Int. Cl.[4] ..... C22B 3/00

[52] U.S. Cl. ..... 75/101 R; 75/114; 75/117; 75/118 R; 75/119; 75/120; 75/121; 423/27; 423/38; 423/49; 423/109; 423/150; 423/DIG. 4

[58] Field of Search ..... 423/46, 27, 38, 49, 423/109, 150, DIG. 4, 143, 395; 75/101 R, 114, 120, 121, 117, 119, 103

[56] References Cited

U.S. PATENT DOCUMENTS

| | | | |
|---|---|---|---|
| 2,762,703 | 9/1956 | Mancke | 75/101 R |
| 3,097,064 | 7/1963 | Caldwell | 423/5 C |
| 3,854,930 | 12/1974 | Kentro | 423/56 |
| 3,923,615 | 12/1975 | Kane et al. | 423/DIG. 4 |
| 3,986,866 | 10/1976 | Coffer | 423/143 |
| 3,988,418 | 10/1976 | Kerfoot et al. | 423/57 |
| 4,026,773 | 5/1977 | Van Peteghem | 423/46 |
| 4,150,091 | 4/1979 | Peterson | 423/DIG. 4 |

*Primary Examiner*—Robert L. Stoll
*Attorney, Agent, or Firm*—Tod R. Nissle

[57] ABSTRACT

An improved hydrometallurgical process for extracting metals from ocean-mined ferromanganese nodules. The process includes the steps of contacting the ferromanganese nodules in an extraction zone with an aqueous solution containing effective amounts of chloride ions and nitrate ions necessary to displace metal values in the ore at an elevated temperature and continuing the contact to form an extraction mixture slurry including a liquid component comprising an aqueous solution containing extracted metal values from the ferromanganese nodules dissolved therein and a solid tailing component; and, separating the liquid and solid components of the extraction mixture slurry.

2 Claims, 1 Drawing Sheet

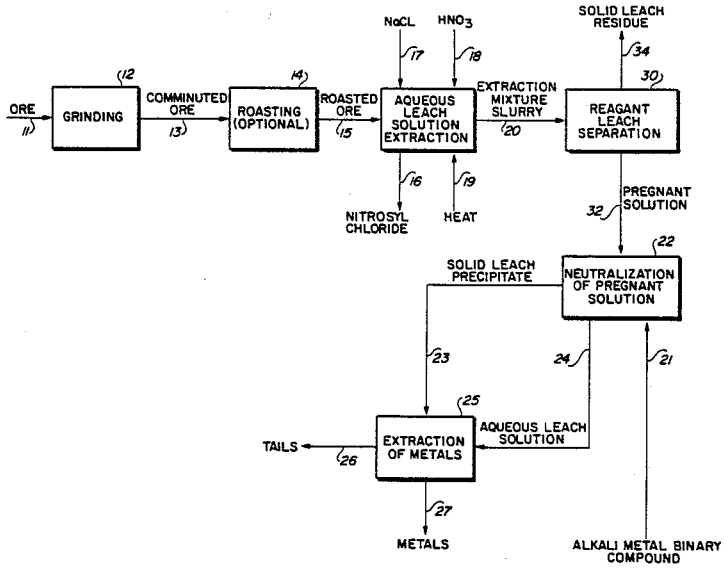

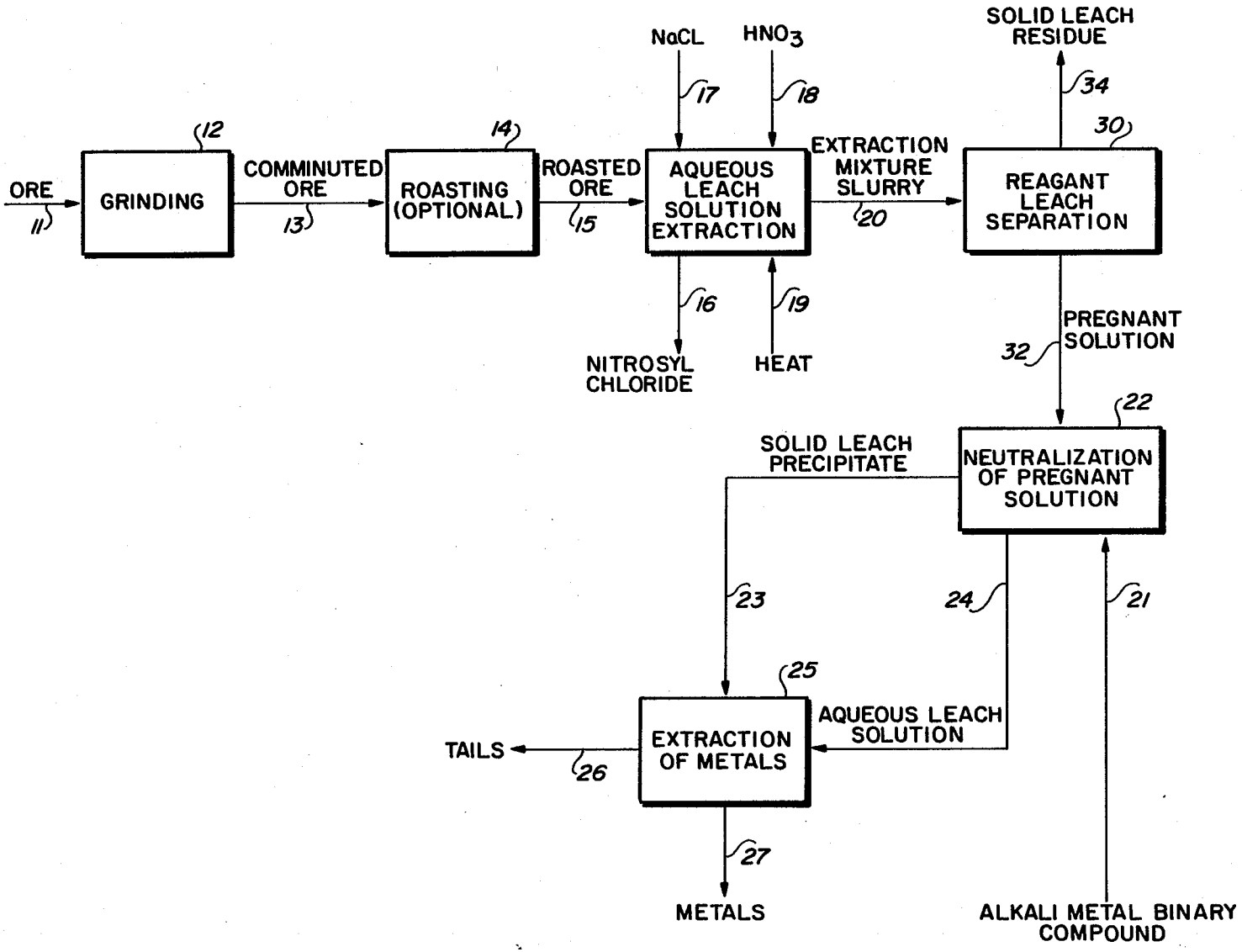
ORE
11
GRINDING
12
COMMINUTED ORE
13
ROASTING (OPTIONAL)
14
ROASTED ORE
15
NaCL
17
HNO3
18
AQUEOUS LEACH SOLUTION EXTRACTION
16
NITROSYL CHLORIDE
19
HEAT
EXTRACTION MIXTURE SLURRY
20
REAGANT LEACH SEPARATION
30
34
SOLID LEACH RESIDUE
PREGNANT SOLUTION
32
NEUTRALIZATION OF PREGNANT SOLUTION
22
21
ALKALI METAL BINARY COMPOUND
24
AQUEOUS LEACH SOLUTION
SOLID LEACH PRECIPITATE
23
25
EXTRACTION OF METALS
27
METALS
26
TAILS

HYDROMETALLURGICAL PROCESS FOR EXTRACTING METALS FROM OCEAN-MINED FERROMANGANESE NODULES

This invention relates to a process for extracting metals from ores.

More particularly, the invention concerns a hydrometallurgical process for extracting noble and other metals from ferromanganese nodules found on the ocean floor and from other sulfide, oxide or chloride ores which are difficult to process.

Ferromanganese modules found on the ocean floor contain approximately thirty minerals, many of which are in limited world wide supply and are becoming increasingly difficult to obtain. The nodules include copper (1.25 weight percent of a high-grade nodule), manganese (25–35 weight percent of a nodule), and nickel (1.5 percent). These metals are important to the industrialized nations of the world. Manganese and nickel are utilized in the production of steel. Cobalt is utilized in the manufacture of various high-temperature alloys. One problem which makes mining ferromanganese nodules less attractive is the difficulty of extracting metals from the nodules. There is no ore on earth like ferromanganese nodules. Two extraction approaches are presently being investigated. One approach is hydrometallurgical and proposes the utilization of ammonia, sulfuric acid or hydrochloric acid to put metals from the nodules into solution. The other approach is pyrometallurgical and proposes smelting nodules to separate the nodules into slag, ores and matte. Matte is a mixture of metal and its oxides. The matte is then leached to put metals into an aqueous leach solution. The leach solution is processed to remove the metals. However, at present, there apparently is no economical, practical metallurgical process for removing metals from ferromanganese nodules.

In accordance with the invention, I have now discovered a hydrometallurgical process for extracting cobalt, copper, manganese, nickel, zinc and other elements from ferromanganese nodules and for extracting metals from other difficult to process ores. In my improved process, I contact comminuted ferromanganese nodules or other ores at an elevated temperature with an aqueous solution containing effective amounts of chloride and nitrate ions to form an extraction mixture slurry. After the comminuted ore has been contacted with the aqueous chloride-nitrate solution for a desired period of time, the extraction mixture slurry is neutralized to a pH of 7 by adding an alkali metal binary compound to the solution to precipitate metals from the solution. The precipitate can be processed in accordance with a variety of conventional extraction processes. Metal values remaining in the leach solution can be similarly removed in accordance with a variety of conventional extraction processes.

The drawing illustrates an overall process for extracting metals from ores such as ferromanganese nodules, pentlandite from Ontario, Canada, and Pioche Mill tailings from Nevada. Ore 11 is ground 12. For each particular ore and treatment facility, the optimum degree of grinding is determined by balancing the cost of effecting increasingly finer particle size against the economic benefit of the resulting reduced retention time during treatment of the comminuted ore with leach solution. By way of example, in utilizing the process of the invention, Pioche Mill tailings are typically ground to 500 mesh.

Comminuted ore 13 can, if desired, be roasted 14 to reduce the amount of sulfur or other undesirable components in the ore. Roasted ore 15 is subjected to aqueous leach solution extraction step 16 in which ore 15 is slurried with an aqueous solution containing chloride ions 17 and nitrate ions 18. This is preferably done in a sealed container because nitrosyl chloride gas is produced during the chemical interaction of ore 15 and the aqueous leach solution, particularly when the extraction mixture slurry is heated 19. A neutralizing agent 21 is added 22 to pregnant solution 32 to raise the pH of the solution to approximately pH 7. When the neutralizing agent 21 is added 22 to pregnant solution 32, a flocculent metal precipitate 23 is formed. Both precipitate 23 and remaining leach solution 24 can be processed 25 to remove metal values 27 therefrom. As shown in the drawing, pregnant solution 32 is obtained when solid leach residue 34 is separated from extraction mixture slurry 20. Tailings 26, 34 may be discarded or treated to recover other metal values.

Ore 11 can include raw ore, processed ore, or artificially formed mineral compositions. The ratio of moles of water to moles of concentrated nitric acid utilized in the aqueous leach solution is preferably in the range of 20:1 to 50:1 but can be in the range of 1:1 to 200:1. While chemical reactions occur and metal values are extracted from ore 15 at ambient temperatures during aqueous leach solution extraction 16, aqueous leach solution 16 is preferably heated to a temperature in the range of 175° F. to 191° F. As the temperature of the extraction mixture slurry 20 falls below 175° F., the chemical reactions in the slurry progressively slow when the temperature of the slurry exceeds 191° F., nitrosyl chloride is boiled from extraction mixture slurry 20. Since nitrosyl chloride is believed to be one of the principal chemical reactants responsible for the removal of metal values from ore 15, it is desirable to minimize the expulsion of nitrosyl chloride from extraction mixture slurry 20. Approximately one mole of salt is utilized in the aqueous leach solution per one mole of metal desired to be extracted from the ore. In practice, is approximately 20–40% of the volume of ore contacted with the aqueous leach solution. When less than one mole of salt is utilized in the aqueous leach solution per mole of metal, the efficiency of extraction of metals from ore 15 is reduced. If the ratio of moles of water to moles of nitric acid in the leach solution is 50:1 the reaction time required to extract a substantial portion of metals from an ore is typically approximately two to three hours. When the ratio of moles of water to moles of nitric acid n the leach solution is 2:1, the reaction time required for the leach solution to extract a substantial portion of metals from an ore is typically approximately twenty minutes.

The alkali metal binary compounds 21 which can be added 22 to extraction mixture slurry 20 include sodium carbonate, sodium hydroxide, and sodium bicarbonate. The alkali metal binary compound 21 precipitates metals from pregnant solution 32 as carbonates, hydroxides or oxides. Metals precipitated by alkali metal binary compound 21 include copper, nickel, iron, and most metals below sodium in the electromotive series, and generally do not include calcium, potassium, and lithium. The oxide precipitates can, as would be appreciated by those of skill in the art, be heated to drive off the oxygen and produce free metal, or, can be added to hydrochloric, nitric or sulfuric acid and precipitated from the acid with zinc or other appropriate precipitating compounds.

While pregnant solution 32 is preferably neutralized 22 with an alkali metal binary compound 21 in order to facilitate precipitation of metal values from the extraction mixture slurry, when metal ions in pregnant solution 32 are relatively low on the electromotive scale, as are the noble metals, it is often not necessary to neutralize 22 the solution 32 to precipitate such metals from the solution, and, the metals can often be precipitated by simply adding zinc to the solution.

The following examples are presented, not by way of limitation of the scope of the invention, but to illustrate to those skilled in the art the practice of various of the presently preferred embodiments of the invention and to distinguish the invention from the prior art.

EXAMPLE 1

A quantity of tailings from the Pioche Mill, Nev., mine were obtained and analyzed. The results of the analysis are shown below in Table A.

TABLE A

Analysis of Pioche Mill Tailings

| ELEMENT | WEIGHT PERCENT |
|---|---|
| Ag | .005-.03 |
| Al | 1.0-5.0 |
| Au | .001-.005 |
| Be | * |
| Bi | * |
| Ca | .3-1.0 |
| Cd | .005-.03 |
| Co | .01-.05 |
| Cr | .01-.05 |
| Cu | .01-.05 |
| Fe | .5-3.0 |
| Mg | .1-.5 |
| Mn | .01-.05 |
| Ni | .01-.05 |
| Pb | .1-.5 |
| Pd | * |
| Pt | * |
| Sb | .1-.5 |
| Se | * |
| Si | MAJOR |
| Sn | * |
| Sr | .01-.05 |
| Ti | .1-.5 |
| V | * |
| Zn | * |

Ten milliliters of tailings and 2.5 milliliters of salt were combined with 600 milliliters of an aqueous solution of nitric acid to form an extraction mixture slurry. The ratio of moles of water to moles of nitric acid was 20:402 milliliters of the acidic aqueous solution would consist of 360 ml of water and 42 ml of concentrated nitric acid (96% solution of $HNO_3$ in water). The extraction mixture slurry was stirred and heated in a sealed container at atmospheric pressure in a normal ambient air atmosphere at 180° F. for twenty five minutes. After the extraction mixture slurry was heated and stirred for twenty five minutes, 500 ml of the pregnant aqueous solution of the extraction mixture slurry was cooled and decanted. 500 ml of a saturated aqueous solution of sodium carbonate was added to the pregnant solution to precipitate metals from the solution in the form of carbonates and hydroxides. 60 ml of wet precipitates from the pregnant solution were dissolved in 400 ml of a 20% solution of hydrochloric acid. Powdered zinc was added to the hydrochloric acid solution until the pH of the solution was pH 4. Metals precipitated from the solution when the pH of the solution approached pH 4. Metal precipitates from the hydrochloric acid solution were analyzed. The results of the analysis are summarized below in Table B.

TABLE B

Analysis of Hydrochloric Acid Precipitates obtained during Extraction of Metal Values from Pioche Mill Tailings

| Noble Elements | PPM |
|---|---|
| Ag | 8 |
| Au | 58 |
| Pd | 4 |
| Pt | 25 |
| Ir | 149 |
| Os | 4135 |
| Rh | 91 |
| Ru | 2068 |

EXAMPLE 2

A quantity of pentlandite ore $(Fe, Ni)_9S_8$ mined at Sudbury in Ontario, Canada, was obtained and analyzed. The ore contained 1-5% by weight copper, and small amounts of cobalt. 10 ml of raw ore was ground to 500 mesh and, along with 2.5 ml of sodium chloride, combined with 600 ml of an aqueous solution of nitric acid to form an extraction mixture slurry. The ratio of moles of water to moles of nitric acid in the aqueous solution was 25:1; 492 ml of the acidic aqueous solution would consist of 450 ml of water and 42. ml of concentrated nitric acid (96% solution of $HNO_3$ in water). The extraction mixture slurry was stirred and heated in a sealed container at atmospheric pressure in a normal ambient air atmosphere of oxygen and nitrogen at 180° F. for thirty minutes.

After the extraction mixture slurry was heated and stirred for thirty minutes, 500 ml of the pregnant aqueous solution of the extraction mixture slurry was cooled and decanted. 500 ml of a saturated aqueous solution of sodium carbonate was added to the pregnant solution to precipitate metals from the solution in the form of carbonates and hydroxides. 60 ml of wet precipitates from the pregnant solution were dissolved in 400 ml of a 20% solution of hydrochloric acid. Powdered zinc was added to the hydrochloric acid solution until the pH of the solution was pH 4. Metals precipitated from the solution when the pH of the solution approached pH 4. Metal precipitates from the hyrochloric acid solution were analyzed. The results of the analysis are summarized below in Table C.

TABLE C

Analysis of Hydrochloric Acid Precipitates obtained during Extraction of Metal Values from Pentlandite Ore

| ELEMENTS | WEIGHT PERCENT |
|---|---|
| Ag | .01-.05 |
| Co | .005-.03 |
| Cu | .1-.5 |
| Fe | .1-.5 |
| Ni | .1-.5 |
| Zn | MAJOR |

EXAMPLE 3

A quantity of high-grade ferromanganese nodules from the ocean floor at the Clarion-Clipperton fracture zone were obtained. The nodules contained in excess of 0.25% by weight cobalt, 25% by weight manganese, 0.5% copper, 0.5% nickel. 10 ml of the nodules was ground to 500 mesh and, along with 2.5 ml of sodium chloride, combined with 600 ml of an aqueous solution of nitric acid to form an extraction mixture slurry. The ratio of moles of water to moles of concentrated nitric acid in the aqueous solution was 35:1; 672 ml of the aqueous solution would consist of 630 ml of water and 42 ml of concentrated nitric acid (96% solution of $HNO_3$ in water). The extraction mixture slurry was stirred and heated in a sealed container at atmospheric pressure in a normal ambient atmosphere of oxygen and nitrogen at 180° F. for forty five minutes.

After being heated and stirred for forty five minutes, five hundred milliliters of the pregnant aqueous solution of the extraction mixture slurry was cooled and decanted. 500 ml of a saturated aqueous solution of sodium carbonate was added to the pregnant solution to precipitate metals from the solution as carbonates and hydroxides. 60 ml of wet precipitates from the pregnant solution were dissolved in 400 ml of a 20% solution of hydrochloric acid. Powdered zinc was added to the solution until the pH of the solution was pH 4. Metals precipitated from the pregnant solution when the pH of the solution approached pH 4. Metal precipitates from the hydrochloric acid solution were analyzed. The results of the analysis are summarized below in Table D.

TABLE D

Analysis of Hydrochloric Acid Precipitates obtained during Extraction of Metal Values from Ferromanganese Nodules

| ELEMENTS | WEIGHT PERCENT |
|---|---|
| Ag | .01-.05 |
| Co | .01-.05 |
| Cu | 1.0-5.0 |
| Mn | .005-.03 |
| Ni | 1.0-5.0 |

TABLE D-continued

Analysis of Hydrochloric Acid Precipitates obtained during Extraction of Metal Values from Ferromanganese Nodules

| ELEMENTS | WEIGHT PERCENT |
|---|---|
| Zn | MAJOR |

Having described my invention in such terms as to enable those skilled in the art to understand and practice it and having identified the presently preferred embodiments thereof, I claim:

1. A process for extracting metal values from comminuted manganiferous ocean floor nodule ore containing at least one metal selected from the group consisting of nickel, silver, colbalt, zinc, and copper, said process comprising (a) contacting said comminuted ore in an extraction zone at an elevated temperature with an aqueous leach solution of a chloride salt, nitric acid, and nitrosyl chloride to form an extraction mixture leach slurry including a liquid component comprising an aqueous solution containing extracting metal values from said comminuted ore dissolved therein, said liquid component including water soluble manganese as one of said extracted metal values; and, (b) processing said liquid component to remove said extracted dissolved metal values therefrom;

the relative amount of water and nitric acid in said aqueous solution being equivalent to a ratio of moles of water to moles of concentrated nitric acid in the range of 1:1 to 200:1;

said aqueous solution containing a stoichiometric amount of said chloride salt necessary to displace said metal values from said ore, said stoichiometric amount of chloride salt being equivalent to one mole of salt for one mole of metal values extracted from said ore.

2. The hydrometallurgical process of claim 1, wherein said salt is sodium chloride.

* * * * *